US005158177A

United States Patent [19]

Negelen et al.

[11] Patent Number: 5,158,177

[45] Date of Patent: Oct. 27, 1992

[54] WRAPAROUND MULTIPACK WITH CARRYING HANDLE

[75] Inventors: Emanuel Negelen, Schweich; Rolf Muller, Mehring, both of Fed. Rep. of Germany

[73] Assignee: The Mead Corporation, Dayton, Ohio

[21] Appl. No.: 763,855

[22] Filed: Sep. 23, 1991

[30] Foreign Application Priority Data

May 9, 1991 [GB] United Kingdom ..... 9010431

[51] Int. Cl.[5] ..... B65D 71/48

[52] U.S. Cl. ..... 206/147; 206/434

[58] Field of Search ..... 206/139-143, 206/145, 147-149, 151-158, 160-162, 170, 174, 175, 199, 434

[56] References Cited

U.S. PATENT DOCUMENTS

| | | | |
|---|---|---|---|
| 2,252,235 | 8/1941 | Snelling | 206/158 |
| 3,698,625 | 10/1972 | Graser | 206/434 |
| 3,860,281 | 1/1975 | Wood | 206/158 |
| 4,146,168 | 3/1979 | Hartline . | |
| 4,201,322 | 5/1980 | Crawford . | |
| 4,747,536 | 5/1988 | Wischusen . | |

FOREIGN PATENT DOCUMENTS

| | | |
|---|---|---|
| 1423002 | 11/1965 | France . |
| 480138 | 2/1938 | United Kingdom . |
| 809684 | 3/1959 | United Kingdom . |
| 915935 | 1/1963 | United Kingdom . |

*Primary Examiner*—Jimmy G. Foster
*Attorney, Agent, or Firm*—Erwin Doerr

[57] ABSTRACT

A carton accommodating a plurality of articles, such as bottles (B) comprises a top (14, 16, 18, 20) a base and a pair of side walls (12, 22) interconnecting the top and the base thereby forming a tubular structure has a carrying handle (H) extending upwardly from the top and locking tabs (50, 52, 54) which tie together facing panels (16, 18) at lower portions of said carrying handle to maintain the carrying handle in an upstanding position for use.

6 Claims, 3 Drawing Sheets

WRAPAROUND MULTIPACK WITH CARRYING HANDLE

This invention relates to a carton of the wraparound type accommodating a plurality of articles and which includes an upstanding carrying handle.

In some European markets there is an increasing need for packages which retain bottles in a group of, say, six bottles to provide for the return of the bottles to the point of sale. A number of such "six-packs" are accommodated in a crate which is placed on display so that individual six-packs may be withdrawn from the crate and purchased. Empty bottles are returned in the wraparound carton which is deposited in the crate and the crate then despatched so that the bottles can be recycled for future use.

A carton according to the present invention is suitable for use in such crates and presents to a customer an upstanding handle by which the carton can be removed from the crate. Moreover, in preferred constructions of the carton, the upper portions of the packaged articles, e.g. the necks of bottles, protrude from the carton top which facilitates unloading of the bottles from the crate by automatic bottle unloading equipment which leaves discarded cartons behind in the crate for subsequent removal.

One aspect of the present invention provides a carton accommodating a plurality of articles, such as bottles, comprising a top, a base and a pair of side walls interconnecting said top and said base thereby forming a tubular structure, carrying handle means extending upwardly from said top and tying means interconnecting lower portions of said carrying handle means to maintain the carrying handle means in a position for use.

According to a feature of this aspect of the invention, said carrying handle means may comprise a pair of juxtaposed panels hinged together remote from the carton top to provide an upstanding handle and wherein lower portions of the handle panels are prevented from moving apart about their hinged connection by said tying means In constructions where the carrying handle comprises a pair of juxtaposed panels said tying means may comprise a locking tab extending from a lower portion of one of said handle panels and locked in an aperture provided adjacent a lower portion of the other of said handle panels.

Preferably, said top includes a plurality of apertures through each of which protrudes a top portion of an article retained by the carton and wherein locking tabs extending from a lower portion of said one handle panel are locked in said plurality of apertures.

According to another feature of this aspect of the invention, said locking tabs may each be struck from respective ones of the apertures in the other of said handle panels.

Another aspect of the invention provides a carton blank for forming a carton according to any of the four immediately preceding paragrahs which blank comprises a first base panel, a first side wall panel, a top including first and second handle panels, a second side wall panel and a second base panel hinged one to the next and wherein said top includes openings formed in said top adjacent each of said first and second handle panels through which upper parts of articles to be packaged protrude and wherein tying means are struck from the openings in the first of said handle panels and adapted to engage in respective ones of the openings in the second of said handle panels.

An embodiment of the invention will now be described, by way of example, with reference to the accompanying drawings, in which.

Figure 1:
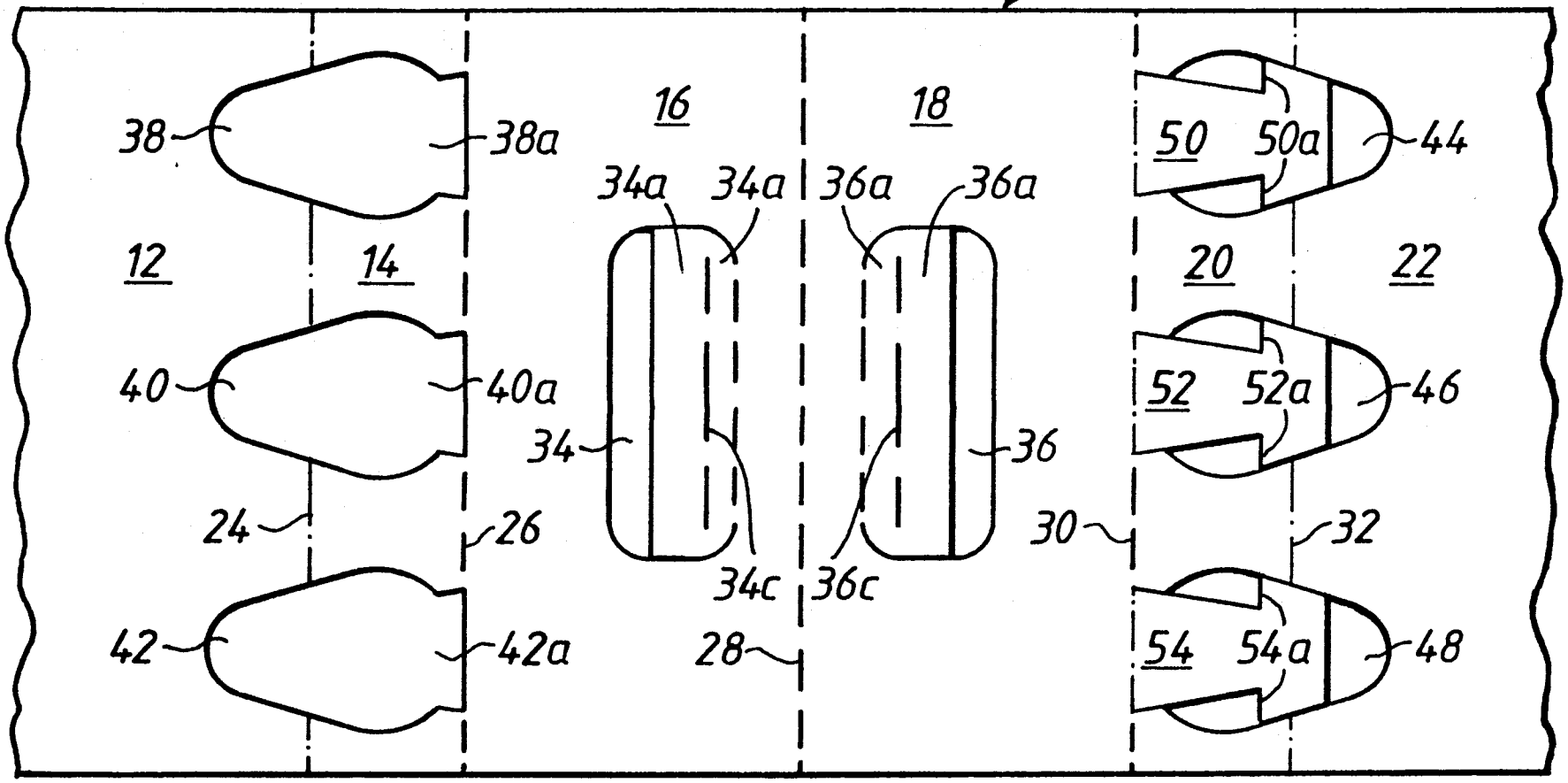
FIG. 1 is a plan view of a central portion of a carton blank for forming a carton according to the invention.

Referring to the drawings, the central part of an elongate blank 10 formed from paperboard or like foldable sheet material comprises, in series, a first side wall panel 12, a first top wall panel 14, a first handle panel 16, a second handle panel 18, a second top panel 20 and a second side wall panel 22 hinged one to the next along transverse fold lines 24 to 32 respectively.

Remaining parts of the blank comprising lower portions of the side walls and base panels hinged thereto are omitted (but can be seen to some extent in FIG. 3) since they are not concerned with the present invention and are carton features well known in the art.

Handle panels 16 and 18 are each formed with handle 34*a*, 34*b* and 36*a*, 36*b* respectively.

A series of three spaced bottle neck receiving apertures 38, 40 and 42 is struck partially from top panel 14 and partially from side wall panel 12 each of the apertures being shaped to provide a locking zone 38*a*, 40*a* and 42*a* respectively adjacent the lower part of handle panel 16. Likewise, a series of three similarly spaced bottle neck receiving apertures 44, 46 and 48 is struck partially from top panel 20 and partially from side panel 22 but do not include locking zones. Instead locking tabs 50, 52 and 54 are struck from the blank within respective ones of the locking apertures 44, 46 and 48. Locking tabs 50, 52 and 54 are hinged to the lower end of handle panel 18 along the hinge line 30 and include T-shaped locking heads which have locking edges 50*a*, 52*a* and 54*a*, respectively.

Thus, the blank is adapted to be wrapped about a group of six bottles arranged in two rows of three bottles each so that neck portions of the bottles protrude through the neck receiving apertures while the handle panels together form an upstanding handle between the rows of bottles.

In order to apply the carton blank to the bottles, first the hand cushioning flaps 34*a* and 36*a* are folded through 180 degrees and secured in face to face relationship with adjacent hand cushion flaps 34*b* and 36*b* respectively about fold lines 34*c* and 36*c*.

Figure 2:
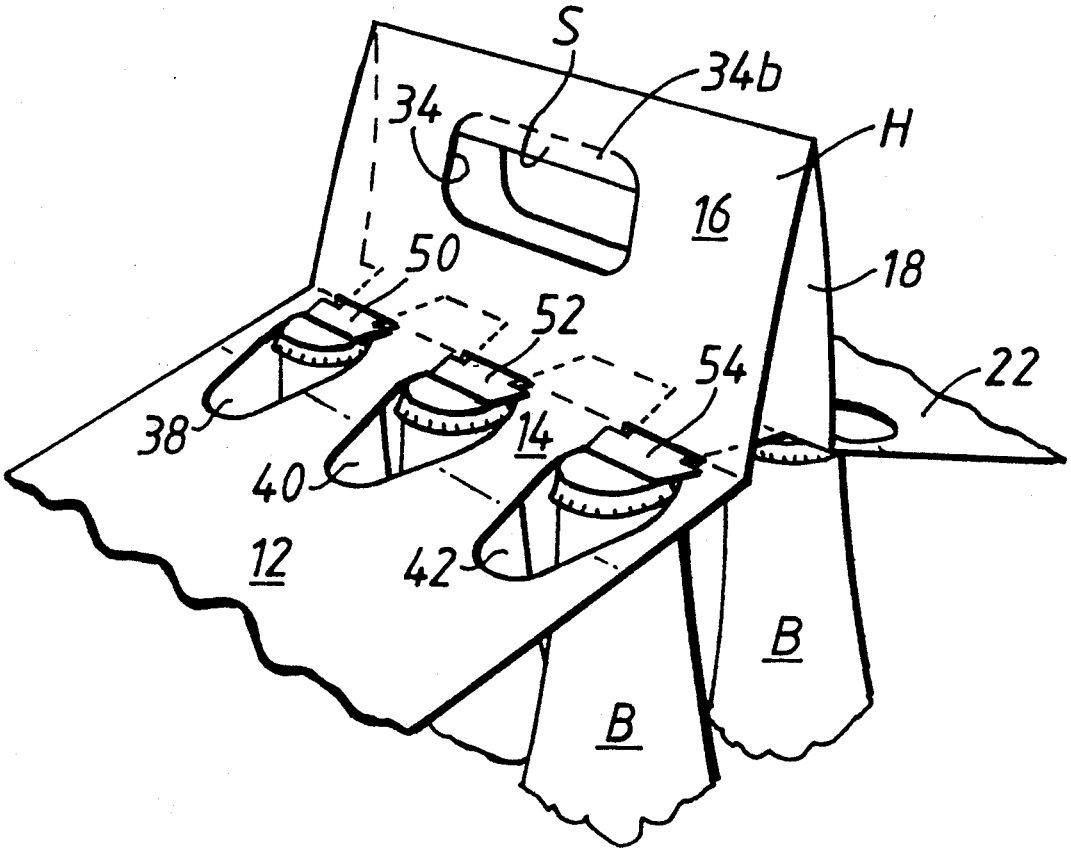
FIG. 2 is a perspective view showing a central portion of the blank incorporating an upstanding handle being applied to a group of bottles to be packaged.
Figure 3:
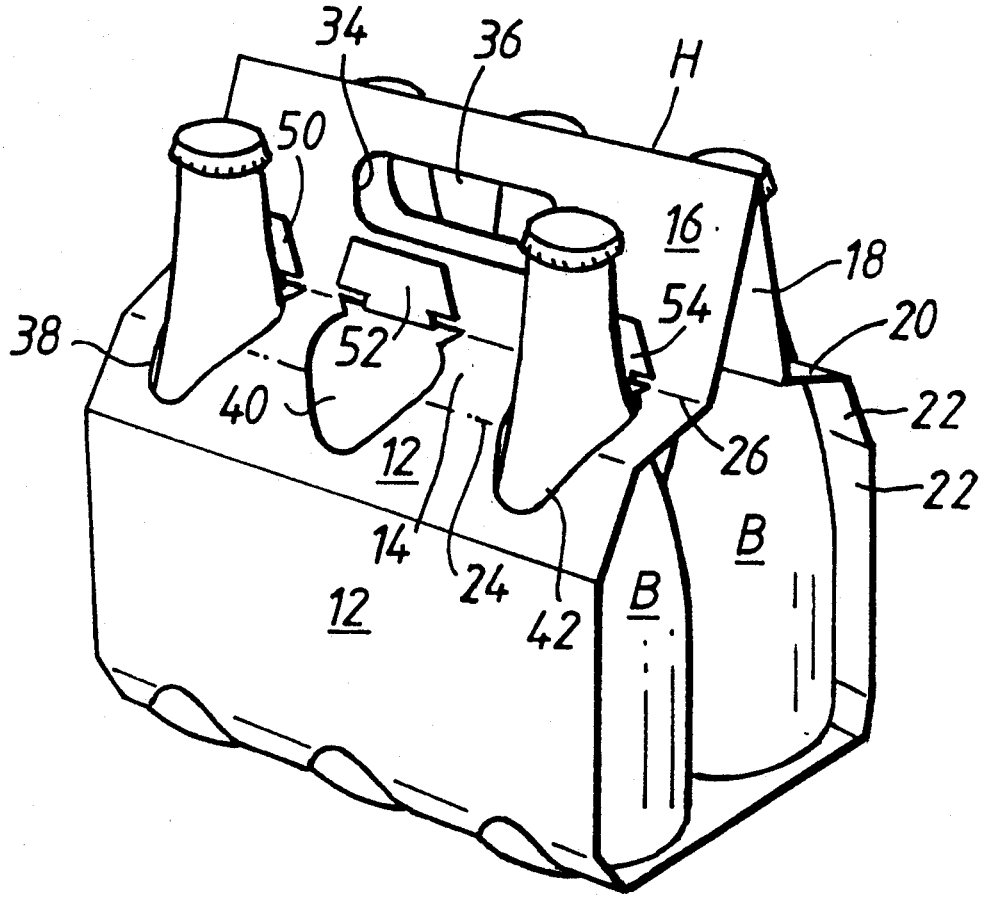
FIG. 3 is a perspective view of a completed carton according to the invention but with one central bottle removed to reveal one of the locking tabs.

Thereafter, the handle panels are erected into juxtaposition out of the plane of the blank so that the handle apertures more less are brought into registry with one another. Locking tabs 50, 52 and 54 are then folded about fold line 30 and through 180 degrees so that the heads of the locking tabs appear in respective ones of the apertures 38, 40 and 42 with locking edges 50*a*, 52*a* and 54*a* in locking engagement with the locking zones 38*a*, 40*a*, 42*a*. The blank in this part erected form is then applied to the group of bottles to be packaged so that the handle H formed from handle panels 16 and 18 is disposed between the rows of bottles and with the bottle neck receiving apertures located above the tops of their associated bottles B, as shown in FIG. 2. In this position the heads of the locking tabs interfere with the relative path of movement between the carton blank and the row of bottles to have their necks received in apertures 38, 40 and 42. The carton blank is then applied over the bottle necks whereby the heads of the locking tabs are upwardly displaced and disposed between handle panel 16 and the neck of an adjacent bottle. In FIG. 3 the central bottle of the nearest row is removed to show the general disposition of the locking tab 52. Thus, the handle panels 16 and 18 are tied together by the locking tab 50 so that they are maintained in their virtually upright attitude for use.

It is envisaged that the central bottle neck receiving apertures 40 and 46 could be enlarged, for example, to form extension of the handle apertures 34 and 36 respectively so that the associated bottles may be lifted through the enlarged apertures for use and thus facilitating the unloading of the remaining bottles from the carton.

The carton is of course completed into the form shown in FIG. 3 by causing the side walls 12, 22 to be folded downwardly and the base panels to be folded and secured in overlapping relationship beneath the bases of the loaded bottles. A hand cushioning structure 'S' is provided between the registering handle apertures by flaps 34*b*, 36*b* and flaps 34*a* and 36*a* which are brought into overlapping relationship between the two handle panels.

We claim:

1. A carton accommodating a plurality of articles such as bottles, comprising a top, a base and a pair of side walls interconnecting said top and said base thereby forming a tubular structure, said top having a plurality of apertures through which the top portions of said articles protrude, and a carrying handle means extending upwardly from said top and comprising a pair of juxtaposed panels hinged together remote from said carton top to provide an upstanding handle, and tying means interconnecting lower portions of said carrying handle means to prevent said handle panels from moving apart about the hinged connection thereof, said tying means comprising at least one locking tab extending from the lower portion of one of said handle panels, characterized in that said locking tab is engaged in one of said apertures in said top and retained therein by the upper portion of one of said articles.

2. The carton according to claim 1, further characterized in that said top is provided with two spaced rows of apertures arranged in parallel and aligned relationship and said locking tab is struck from the apertures in one of said rows and engaged in the apertures in the other of said rows.

3. The carton according to claim 2, further characterized in that said handle panels are foldably joined to the top adjacent to and inwardly of said two rows of apertures.

4. The carton according to claim 2, further characterized in that said locking tab is foldably joined to the handle panel adjacent said one row of apertures.

5. The carton according to claim 2, further characterized in that at least a portion of said locking tab is displaced upwardly when the articles are inserted through said apertures in said other of said rows so that said portion of said locking tab is disposed between the adjacent handle panel and the upper portions of said articles.

6. The carton according to claim 5, further characterized in that said locking tab is of T-shaped configuration and the cooperating aperture in said other of said rows provides a narrowed locking zones.

* * * * *